US006673002B2

(12) United States Patent
Trovinger et al.

(10) Patent No.: US 6,673,002 B2
(45) Date of Patent: Jan. 6, 2004

(54) SHEET FOLDING APPARATUS WITH PIVOT ARM FOLD ROLLERS

(75) Inventors: Steven W. Trovinger, Los Altos, CA (US); Ross R. Allen, Belmont, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 09/970,877

(22) Filed: Oct. 5, 2001

(65) Prior Publication Data

US 2003/0069121 A1 Apr. 10, 2003

(51) Int. Cl.[7] ..... B31F 1/08
(52) U.S. Cl. ..... 493/405; 493/434
(58) Field of Search ..... 493/405, 424, 493/429, 434, 442, 44.5, 476

(56) References Cited

U.S. PATENT DOCUMENTS 817,631 A * 4/1906 Diemer ..... 493/388
2,701,989 A * 2/1955 Hayward et al. ..... 493/302
3,202,066 A 8/1965 Palmer (List continued on next page.)

FOREIGN PATENT DOCUMENTS

WO 00/18583 4/2000
WO WO 00/18583 4/2000

OTHER PUBLICATIONS

Steven W. Trovinger et al., U.S. patent application No. 09/970,730 filed Oct. 5, 2001, "Sheet Folding Appartus".
Steven W. Trovinger, U.S. patent application No. 10/259,458 filed Sep. 30, 2002, "Method and Apparatus for Sheet Folding".

*Primary Examiner*—Rinaldi I. Rada
*Assistant Examiner*—Paul R. Durand

(57) ABSTRACT

A system for folding sheet material, including a fold blade, a fold roller, and a driver for moving at least one of the fold blade and the fold roller along a first path into operative communication with one another. The operative communication causes displacement of the fold roller along a longitudinal axis of the fold blade.

15 Claims, 3 Drawing Sheets

U.S. PATENT DOCUMENTS 3,398,661 A 8/1968 Mathes et al.
3,434,399 A 3/1969 Palmer
3,701,522 A * 10/1972 Tzu-Chiang ..... 270/40
3,916,749 A 11/1975 Armelin
3,954,258 A * 5/1976 Skipor et al. ..... 493/445
3,978,773 A 9/1976 Pinto
3,995,849 A 12/1976 Kistner
4,015,838 A 4/1977 Thurmann
4,041,849 A 8/1977 Tsukasaki
4,053,150 A 10/1977 Lane
4,101,121 A 7/1978 Rastorguyeff
4,221,373 A 9/1980 Muller Hans
4,225,128 A * 9/1980 Holyoke ..... 493/421
4,226,410 A 10/1980 McIntosh, Sr. et al.
4,265,437 A 5/1981 Reist et al.
4,310,326 A 1/1982 Bellanca
4,487,597 A * 12/1984 Herrington ..... 493/221
4,496,339 A 1/1985 Moll
4,557,714 A 12/1985 Sabelstrom et al.
4,557,715 A * 12/1985 Robinson ..... 493/244
4,595,187 A 6/1986 Bober
4,614,512 A 9/1986 Capdeboscq
4,643,705 A 2/1987 Bober
4,834,696 A 5/1989 Marschke
4,871,347 A * 10/1989 Brinkmeier ..... 493/302
4,891,681 A 1/1990 Fiske et al.
4,893,803 A 1/1990 Petersen
5,028,193 A 7/1991 Misicka
5,080,339 A 1/1992 Hirahara
5,087,163 A 2/1992 Erdbories et al.
5,092,827 A 3/1992 McAdam, III et al.
5,114,392 A 5/1992 McAdam, III et al.
5,137,505 A * 8/1992 Ishii et al. ..... 493/248
5,145,158 A * 9/1992 Frye ..... 270/45
5,147,276 A 9/1992 Stab
5,169,376 A 12/1992 Ries et al.
5,190,514 A 3/1993 Galvanauskas
5,217,425 A * 6/1993 Cantrell ..... 493/465
5,230,686 A 7/1993 McAdam, III et al.
5,242,364 A 9/1993 Lehmann
5,246,416 A * 9/1993 Demura et al. ..... 493/439
5,346,350 A 9/1994 Luhman et al.
5,377,965 A 1/1995 Mandel et al.
5,452,920 A 9/1995 Parker
5,465,213 A 11/1995 Ross
5,738,620 A 4/1998 Ebner et al.
5,803,891 A 9/1998 Haan et al.
5,937,757 A 8/1999 Jackson et al.
5,957,823 A * 9/1999 Fan ..... 493/248
5,979,348 A 11/1999 Yaguchi
5,997,459 A 12/1999 Kruger et al.
6,090,032 A 7/2000 Bellanca
6,094,225 A 7/2000 Han
6,120,427 A 9/2000 Haan et al.
6,193,458 B1 2/2001 Marsh
6,363,851 B1 4/2002 Gerhard et al.
2003/0069117 A1 4/2003 Trovinger et al.

* cited by examiner

SHEET FOLDING APPARATUS WITH PIVOT ARM FOLD ROLLERS

BACKGROUND OF THE INVENTION

1. Field of the Invention

The present invention relates generally to processing sheet material and, more particularly, to a sheet folding apparatus using pivot arm fold rollers.

2. Background Information

A system for finishing printed sheets into booklets is described in PCT Document No. WO 00/18583 (Trovinger et al.). The Trovinger PCT includes an operation where individual booklet sheets are folded using two drive motor assemblies. A first vertical drive motor assembly operates to immobilize a sheet by pressing it against a fold blade with a folder assembly. This first vertical drive motor assembly moves a set of fold rollers into contact with both the sheet and a longitudinal fold blade. The axes of rotation for the fold rollers are perpendicular to the fold blade used to fold each sheet. A second horizontal drive motor then operates to deform the sheet against the fold blade by reciprocating the set of fold rollers, which have been placed into contact with the sheet, back and forth along the fold blade to in effect crease the sheet. The number and spacing of these rollers are such that during horizontal movement of the fold rollers, at least one fold roller passes over every point along the portion of a sheet where a fold is to be formed.

The system described in the Trovinger PCT uses two separate motors to establish linear motion of fold rollers in two axes to create a fold. The time required to create a fold is the cumulative time of moving a folder assembly vertically and moving the fold rollers horizontally to crease the sheet.

It would be desirable to reduce the apparatus cost and the time required to form a fold in a sheet.

SUMMARY OF THE INVENTION

Accordingly, the present invention is directed to an apparatus that folds sheet material by displacing fold rollers along a fold blade using pivot arms. In this way, only one motor is required to establish linear motion of fold rollers in two axes to create a fold.

According to one embodiment of the present invention, a system for folding sheet material is provided, comprising a fold blade, a fold roller, and drive means for moving at least one of the fold blade and the fold roller along a first path into operative communication with one another, wherein the operative communication causes displacement of the fold roller along a longitudinal axis of the fold blade.

According to another embodiment of the present invention, a method for folding a sheet of material, comprising the steps of feeding a sheet material into an area between a fold roller and a fold blade, and moving the fold roller and the fold blade relative to one another to form a fold in the sheet using the fold blade, wherein an operative communication between the fold roller and the fold blade causes displacement of the fold roller along a longitudinal axis of the fold blade.

BRIEF DESCRIPTION OF THE DRAWINGS

Other objects and advantages of the present invention will become more apparent from the following detailed description of preferred embodiments, when read in conjunction with the accompanying drawings wherein like elements have been represented by like reference numerals and wherein.

DETAILED DESCRIPTION OF THE INVENTION

Figure 1A:
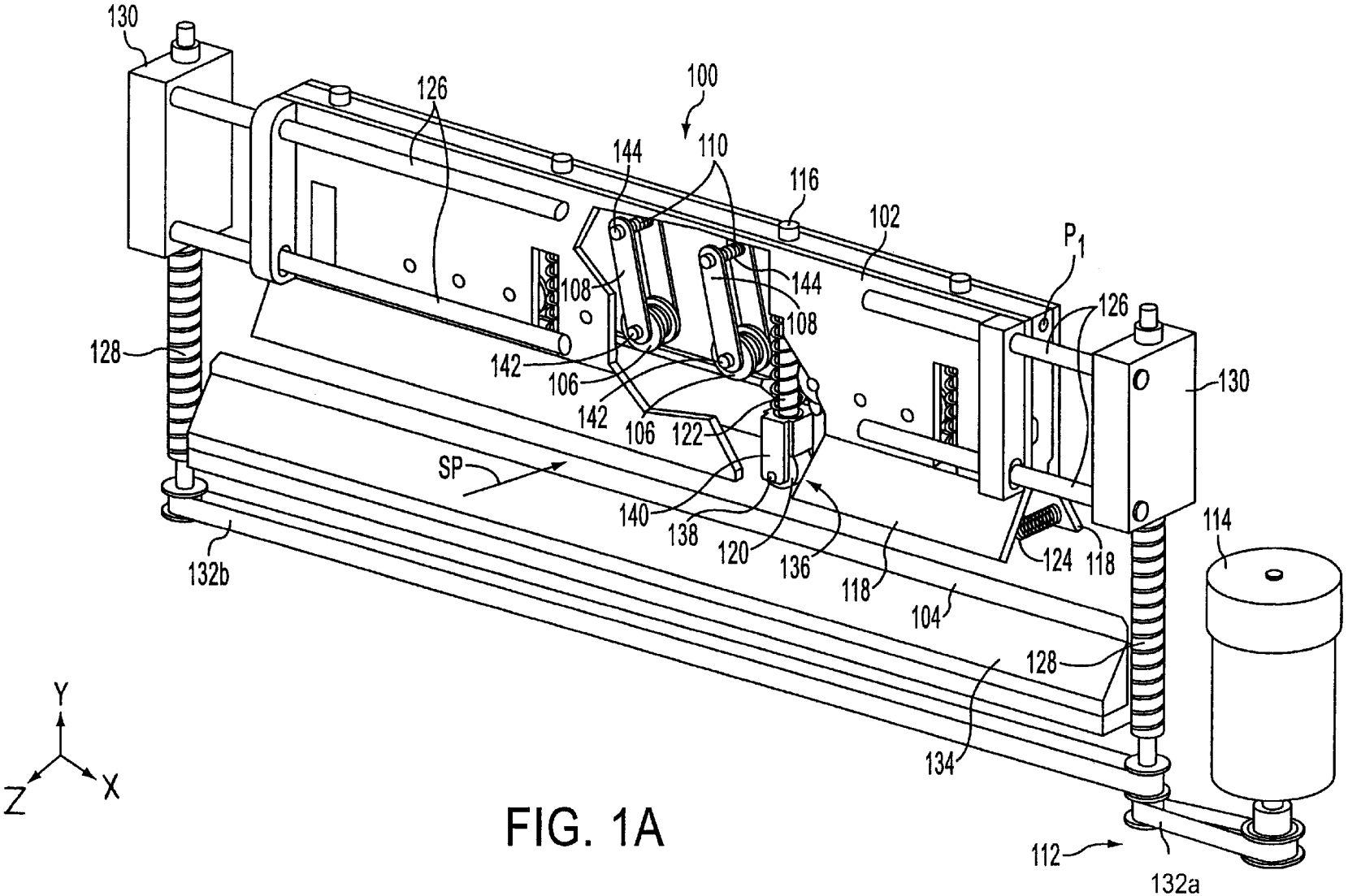
FIGS. 1A and 1B illustrate perspective views of a folding apparatus in accordance with an exemplary embodiment of the present invention.
Figure 1B:
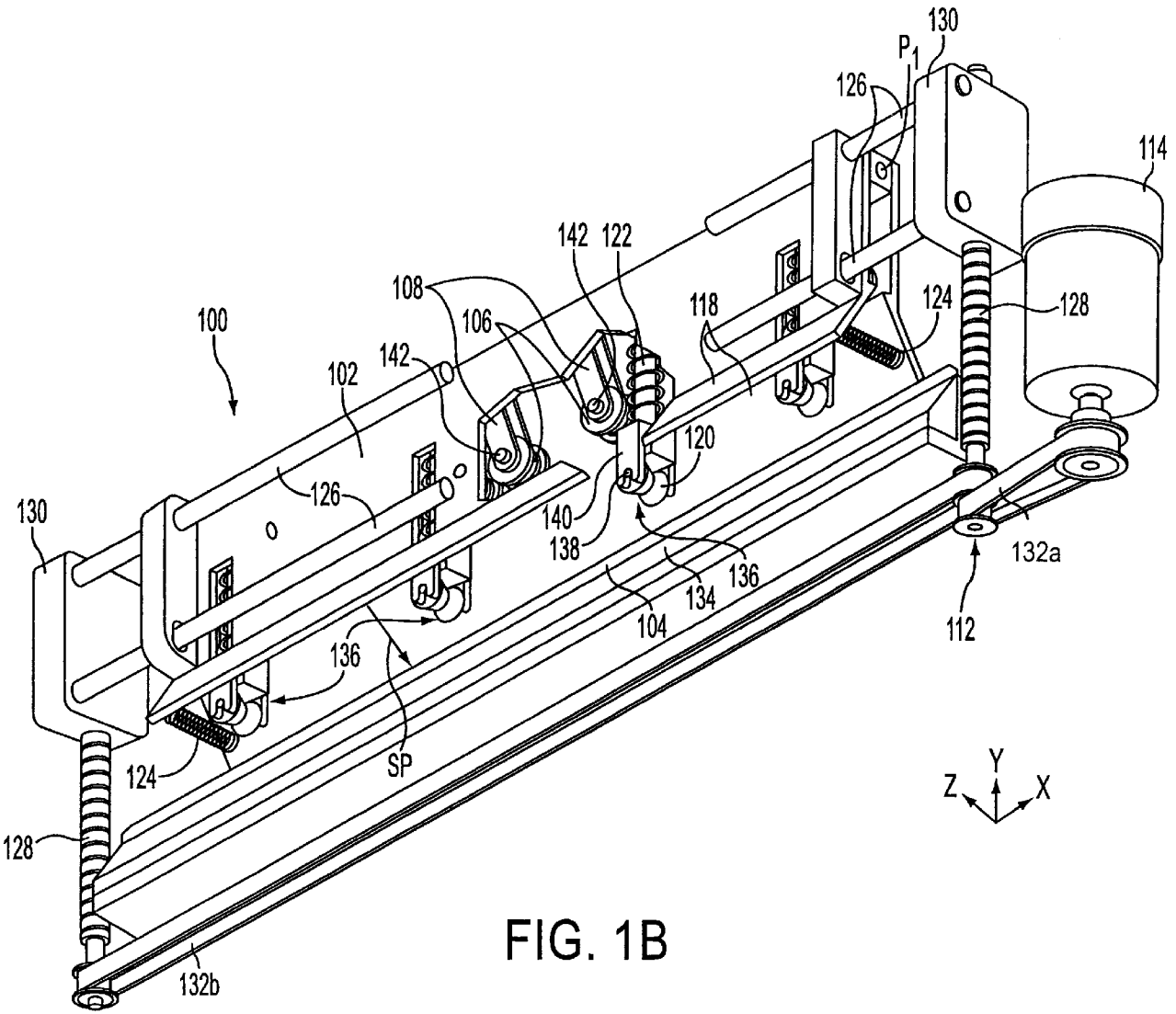

An system for folding sheet material is represented as folding apparatus 100 in FIGS. 1A and 1B. The exemplary folding apparatus 100 includes a fold blade, such as fold blade 104 having a longitudinal axis along the x-axis of FIG. 1A. Fold blade 104 is shown to be held by a blade holder 134, but can alternatively be held by any other stabilizing structure or can be manufactured with blade holder 134 as a unitary component. Fold blade 104 can be fixed or can alternatively be movable (for example, along rails 128 in the y-axis of FIG. 1A, or any desired axis). Fold blade 104 can be made of metal (such as stainless steel) or any other formable material, and can be shaped as a flat strip or can include a rounded shape, these example being non-limiting, of course.

Folding apparatus 100 also includes a roller, such as one of rollers 106, which can be any number in quantity. Each exemplary roller 106 rotates about an axis perpendicular to a longitudinal axis of fold blade 104 (in the FIG. 1A example, this axis of rotation is in the z-axis). Rollers 106 can be made of metal or any other formable material, and can be coated with an elastomeric or deformable material such as an elastomer. Rollers 106 can be circular in cross-section (as shown in the figures), or can alternatively have any other cross-sectional shape that can operate with fold blade 104 to create a fold in sheet material.

A drive means is provided for moving at least of the fold blade and the at least one roller into operative communication with one another. As referred hereon, "operable communication" means placement of the fold blade and/or the fold roller relative to one another to achieve a desired fold in a sheet material. For example, the operative communication can include the interfacing of fold rollers 106 with fold blade 104, directly or indirectly (i.e., through sheet material 248, FIGS. 2A–2C). In the exemplary embodiment shown in FIGS. 1A and 1B, the drive means is represented by drive assembly 112, which includes a lead screw (represented by one of lead screws 128), where a rotation of the lead screw in a first direction is operable to move the fold roller against the fold blade to create a fold in a sheet material. Drive assembly 112 also includes motor 114 and belts 132*a* and 132*b*. Motor 114 can be of any conventional type (such as electric, pneumatic, or hydraulic), or can be of any other type. The exemplary lead screws 128 can be rotated by motor 114 via drive belts 132*a* and 132*b* or alternatively by any other power transmitting element, such as a chain. Also, drive assembly 112 can alternatively be formed as any other actuating system, such as, but not limited to, four-bar linkages, slider-crank mechanisms, pulleys and belts, rack and pinions, and linear actuators (e.g., soleniods, linear electric motors, and hydraulic or pneumatic cylinders), As motor 114 is driven by a power supply and controlled by, for example, a controller, lead screws 128 rotate and cause brackets 130 to move along the y-axis, the direction of their movement dependent on the direction of rotation of the lead screws 128. Housing 102 is connected to brackets 130 by rods 126 and thereby translates along the y-axis when motor 114 is driven. Housing 102 can be fixedly attached to rods 126, or can alternatively be slidable along rods 126 in the x-axis. Such mobility can be useful when adjusting folding apparatus 100 to accommodate a sheet material's feed position. Housing 102 has a longitudinal axis in the x-axis and can be made of any formable material, such as, but not limited to, metal or plastic.

In the exemplary folding apparatus 100, the operative communication causes displacement of the fold roller along a longitudinal axis of the fold blade. For example, such displacement (e.g., rolling travel) of fold rollers 106 along a longitudinal axis of fold blade 104 can be achieved by the use of a pivot arm, such as one of pivot arms 108, where a fold roller is rotatably attached to a first end of the pivot arm. In the embodiment shown in FIGS. 1A and 1B, rollers 106 are each rotatably attached via roller axles 142 to one end (i.e., the first end) of a pivot arm 108. The other ends (i.e., the second ends) of the pivot arms 108 are rotatably attached to housing 102 via arm axles 144. Each pivot arm 108 can be identical in length, or can alternatively differ in length. As described below in conjunction with FIGS. 2A–2C, the operative communication results in a pivoting of the arm (e.g., one of pivot arms 108) such that the fold roller (e.g., one of fold rollers 106) rotates along the longitudinal axis of the fold blade (e.g., fold blade 104).

Folding apparatus 100 also includes a spring (such as one of arm springs 110) attached to the second end of the pivot arm, where the spring forces the fold roller against the fold blade as the fold rollers rotates along the longitudinal axis of the fold blade. In the embodiment shown in FIGS. 1A and 1B, each spring 110 is attached to a pivot arm 108 and to an arm axle 144. When housing 102 is advanced such that rollers 106 press against fold blade 104, springs 110 maintain pressure against fold blade 104 via rollers 106 as housing 102 continues its advancement (this process is described below). Springs 110 can be torsion springs or can be in the form of any other biasing components. All of the springs 110 can have identical spring rates, or these rates can differ from one spring 110 to the other. Depending on the spring rates used, very high forces in the −y-axis (i.e., towards fold blade 104) can be achieved, and sheet material of varying composition and thickness can be folded.

Housing 102 includes at least one pinch wheel, such as one of pinch wheels 120, for clamping sheet material against the fold blade, wherein the at least one pinch foot is elastically mounted to the housing. Each pinch wheel 120 is part of a pinch assembly 136, which includes a pinch bracket 140, a pinch axle 138, a pinch shaft 116, and a pinch spring 122. Each pinch wheel is rotatably attached to a pinch bracket 140 via a pinch axle 138, and each pinch bracket is attached to housing 102 via a pinch shaft 116 and pinch spring 122. Pinch shafts 116 permit vertical translation of pinch assemblies 136 during a folding operation. The FIG. 1B example shows four pinch assemblies 136, although this number can alternatively be greater or lesser. Also, pinch assemblies 136 can alternatively include pinching components that are not rotatable and are not formed as wheels. For example, the clamping operation of pinch wheels 120 can instead be performed by a non-rotatable pinch foot with a v-shaped groove.

Pinch wheels 120 are rotatable about pinch axles 138 and can be made of any formable material (metal and plastic being non-limiting examples) or of a deformable or elastomeric material. In the embodiment shown in FIGS. 1A and 1B, each pinch wheel 102 has a concave cylindrical contact surface, but this surface can also be a different shape (e.g., convex or flat). Pinch springs 122 can be linear, coil springs or can alternatively be any other elastic attaching means. Pinch wheels 120 are vertically biased by pinch springs 122 such that housing 102 can continue to translate towards fold blade 104 after pinch wheels 232 have engaged a sheet against fold blade 104, thereby anchoring it in place during a fold operation.

Housing 102 also includes fold flaps, such as two fold flaps 118, for forcing a sheet material around the fold blade. Fold flaps 118 can be arranged to have any angle between them such that blade holder 134 fits between fold flaps 118 during a folding operation. Fold flaps 118 can be manufactured with housing 102 as a unitary component or separately from housing 102, and can be manufactured from the same material as housing 102 or from a different, formable material. Fold flaps 118 can be pivotally attached to each other at a pivot point $P_1$ and can also be pivotably biased towards each other by using, for example, flap springs 124. This arrangement allows the adjusting of the angle between fold flaps 118 to accommodate different sheet material thickness. Alternatively, any other elastic connecting means can be used to bias the fold flaps 118 towards one another, or fold flaps 118 can be fixedly attached to each other.

Figure 2A:
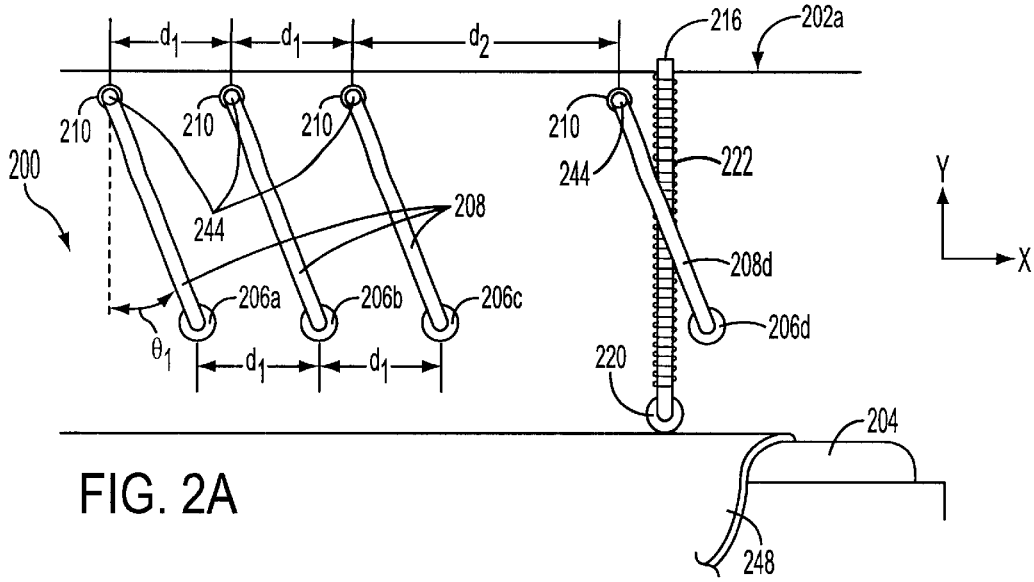
FIGS. 2A–2C illustrate in side, cutaway view a folding operation in accordance with the exemplary embodiment of FIGS. 1A and 1B.
Figure 2B:
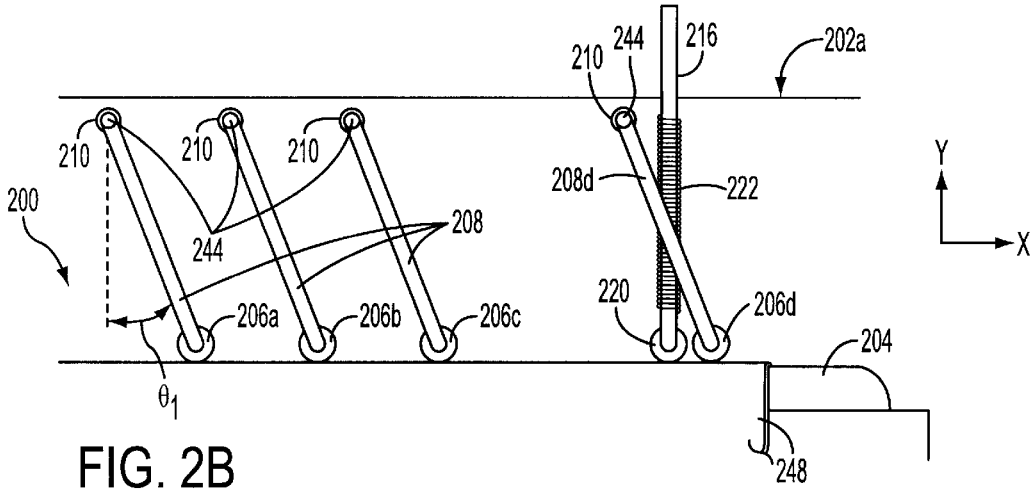
Figure 2C:
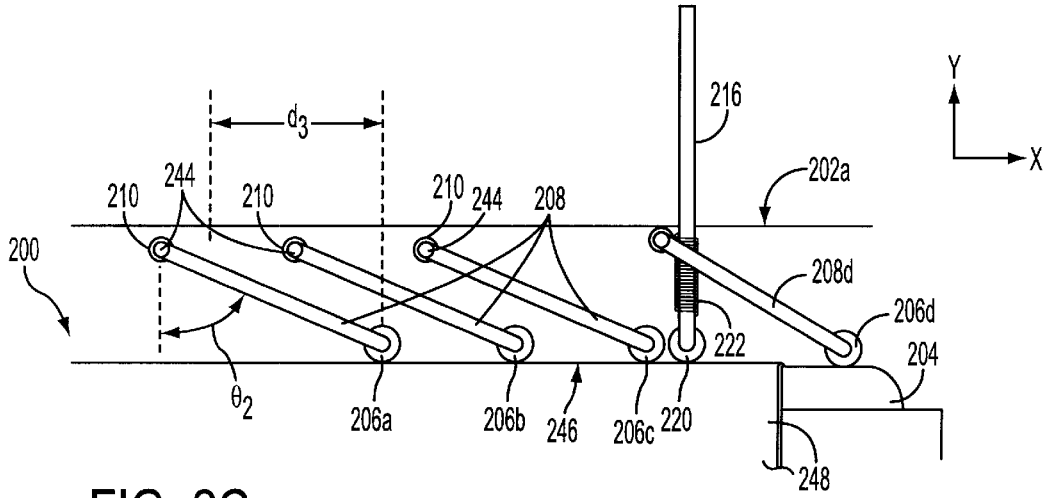

The operation of the folding apparatus 100 is illustrated in FIGS. 2A–2C, where the method includes a step of feeding a sheet material into an area between a fold roller and a fold blade. For example, sheet material 248 in FIGS. 2A–2C is advanced a predetermined distance into the folding apparatus 200 in the +z or −z direction such that sheet material 248 is positioned between fold rollers 206 and fold blade 204. FIGS. 1A and 1B illustrate a sheet path SP of sheet material 248 in the −z direction, for example. The predetermined distance can be chosen by the desired width of the booklet and, for example, the location of the sheet in the booklet, as described in the Trovinger PCT. Sheet material 248 is positioned across fold blade 204 such that the location where a fold is desired is placed directly over the fold blade 204.

Once sheet material 248 is positioned over the fold blade 204, housing 102 translates towards sheet material 248 and fold blade 204 in the −y direction through operation of drive assembly 112 (FIGS. 1A and 1B). FIG. 2A illustrates the instance where initial contact is made between a pinch wheel 220 and sheet material 248. A line 202*a* represents the position of the top of housing 202 relative to the other components of folding apparatus 200. FIGS. 2A–2C illustrate the use of one pinch wheel 220, but alternatively any number of pinch wheels 220 can be used. Pinch wheel 220 captures sheet material 248 against fold blade 204 by the force created by pinch springs 222. In an alternative embodiment, pinch wheel 220 is not included in folding apparatus 200, and its clamping function is instead performed by fold rollers 206 themselves.

When pinch wheel 220 makes its initial contact with sheet material 248, fold rollers 206 are not yet in contact with sheet material 248. FIGS. 2A–2C each illustrate four fold rollers 206, but this number can alternatively be less or greater. Distance $d_1$ represent the distance between fold rollers 206*a* and 206*b* and between fold rollers 206*b* and 206*c*. Distance $d_2$ represents the distance between fold roller 206*c* and 206*d*. Distances $d_1$ and $d_2$ can be identical in length or can be different, as shown in FIGS. 2A–2C. Also, alternatively, the distances between fold rollers 206*a* and 206*b* and between fold rollers 206*b* and 206*c* can be different. In FIG. 2A, all four fold rollers 206 and pivot arms 208 are shown to be positioned at a default angle $\theta_1$ from the y-axis. This is to allow for the rotation of pivot arms 208 about arm axles 244 when the housing is translated along the y-axis and when the fold rollers 206 contact sheet material 248 or fold blade 204. Angle $\theta_1$ can be of any angle within the range of around 1 degree to 90 degrees, depending on, for example, the construction and length of sheet material to be folded. Alternatively, each or some of the fold rollers 206 can be initially positioned at different angles from one another.

After pinch wheel 220 secures sheet material 248, housing 102 continues to translate towards fold blade 204 and fold flaps 118 (FIGS. 1A and 1B) start to contact and bend sheet material 248 around the top of fold blade 204, as described in the Trovinger PCT. Sheet material 248 remains captured between pinch wheel 220 and the fold blade 204. A slack loop can be form in sheet material 248 by, for example, a paper drive assembly, as described in the Trovinger PCT.

The method also includes the step of moving the fold roller and the fold blade relative to one another to form a fold in the sheet using the fold blade, wherein an operative communication between the fold roller and the fold blade causes displacement of the fold roller along a longitudinal axis of the fold blade. FIG. 2*b* illustrates the instance where fold rollers 206 (i.e., the v-shaped grooves of fold rollers 206) initially contact the portion of sheet material 248 lying on the top edge of fold blade 204. At this point, the pinch wheel 220 continues to maintain a securing force against sheet material 248 and fold blade 204 through the biasing action of the compressed pinch spring 222. Also at this point, pivot arms 208 have not yet begun to rotate about arm axles 244. However, as housing 202 continues to advance, pivot arms 208 rotate about arm axles 244 in the z-axis, resulting in the rolling of fold rollers 206 along sheet material 248 in the +x direction. The biasing force created by arm springs 110 ensure that fold rollers 206 produce a sharp crease in sheet material 248 as they roll on and deform sheet material 248 around fold blade 204. Each fold roller 206 can include, for example, two roller halves that can be adjusted to accommodate sheet material of varying thickness. For example, roller halves can be biased toward or away from each other with the use of springs.

FIG. 2C illustrates the position of housing 102 at its furthest advancement towards fold blade 204. At this position, pivot arms 208 are each located at a rotational distance $\theta_2$ from the y-axis, and fold rollers 206 have each traveled a distance d3 in the +x direction (provided that pivot arms 208 all begin at an identical default position and are identical in length). Alternatively, each or some of the fold rollers 206 can travel a different distance from the other fold rollers 206.

Folding apparatus 200 includes multiple fold rollers, as described above, and an initial positioning of the fold rollers is such that movement of one fold roller overlaps the movement of another fold roller. In other words, the default distances $d_1$ and $d_2$, the lengths of pivot arms 208, and default angles $\theta_1$ are all chosen such that the travel of each fold roller 206 along sheet material 248 is such that every point along a created fold 246 is contacted and creased by at least one fold roller 206. For example, in FIGS. 2A–2C, the distance $d_3$ traveled by each fold roller 206*a*–206*c* is greater than the initial distance between these fold rollers (i.e., is greater than $d_1$). In the case of fold roller 206*d*, the above characteristics (e.g., pivot arm length, default angle, etc.) are chosen such that fold roller 206*d* creases fold 246 and moves beyond the edge of sheet material 248 to ensure the integrity of the fold. The above characteristics are also chosen such that the operation of pinch wheel 220 is not interfered. For example, when housing 202 reaches its furthest point of advancement, the travel of fold roller 206*c* (FIG. 2C) ends at the area on sheet material 238 where pinch wheel 220 is positioned. Also, the initial position of fold roller 206*d* (FIG. 2A) is such that it begins its travel on sheet material 248 at an area directly adjacent to the location of pinch wheel 220. Further, pivot arm 208*d* can be formed such that its rotation does not contact or interfere with pinch shaft 216 and pinch spring 222. For example, pivot arm 208*d* (or any other pivot arm) can be formed by one or more components (as shown in FIGS. 1A and 1B), where pinch shaft 216 and pinch spring 222 are positioned between these components.

The above process can be repeated to fully crease sheet material 248 along the length of fold 246. For example, housing 202 can be moved from the position shown in FIG. 2*b* to the position shown in FIG. 2C multiple times, while sheet material 248 remains secured to fold blade 204 by pinch wheel 220. The portion portions of fold 248, due to the fact that fold rollers 206 do not roll this area of sheet material 248 against fold blade 204 during a folding operation. When producing a booklet with a sheetwise process, as described in the Trovinger PCT, these pinched portions of a stack of sheet material 248 can be stapled together to form a booklet of folded sheets. Once fold 246 is fully formed in sheet material 248, housing 202 is translated away from fold blade 204 to the position shown in FIG. 2A, i.e., out of the sheet path. In so doing, pinch wheel 220 releases folded sheet material 248 from fold blade 204. Folded sheet material can then be ejected from folding apparatus 200 and delivered to a downstream device, such as a sheet-collecting saddle, for example.

The exemplary embodiments of the present invention provide for quicker folding of sheet material at a lower apparatus cost, due to the use of a single motor to drive fold rollers in two axes to create folds in sheet material. In this way, folds can be formed in one smooth motion instead of two reciprocating motions. Exemplary embodiments of the present invention can be modified to include features from any or all of the following copending applications, all filed on even date herewith, the disclosures of which are hereby incorporated by reference in their entirety: Sheet Folding Apparatus, Ser. No. 09/970,730; Thick Media Folding Method, Ser. No. 09/970,748; Variable Media Thickness Folding Method, Ser. No. 09/971,351 and Sheet Folding Apparatus With Rounded Fold Blade, Ser. No. 09/970,840.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A method for folding a sheet of material, comprising the steps of:

feeding a sheet material into an area between a fold roller and a fold blade; and moving the fold roller and the fold blade relative to one another to form a fold in the sheet using the fold blade, wherein an operative communication between the fold roller and the fold blade displaces the fold roller along a longitudinal axis of the fold blade, and the operative communication pivots at least one fold arm having the fold roller rotatably attached to a first end, the arm being pivotably attached to a housing of a fold apparatus, such that the fold roller rotates along the longitudinal axis of the fold blade.

2. The method of claim 1, comprising translating the housing relative to the fold blade.

3. A system for folding sheet material, comprising:

a fold blade;

at least one fold roller;

drive means for moving at least one of the fold blade and each of the at least one fold rollers along a first path into operable communication with one another; and at least one arm, wherein each arm has one of the at least one fold rollers rotatably attached to a first end and the arm is pivotably attached to a housing of the fold apparatus, wherein the operative communication causes displacement of each of the at least one fold rollers along a longitudinal axis of the fold blade, and wherein the operative communication pivots each of the at least one arms such that each of the at least one fold rollers rotates along the longitudinal axis of the fold blade.

4. The system of claim 3, wherein the drive means comprises:

a lead screw, wherein a rotation of the lead screw in a first direction is operable to move each of the at least one fold rollers against the fold blade to create a fold in a sheet material.

5. The system of claim 3, comprising:

a plurality of springs, one of the plurality of springs attached to a second end of each of the at least one arms, wherein the one spring forces the fold roller of the at least one arm against the fold blade as the fold roller rotates along the longitudinal axis of the fold blade.

6. The system of claim 5, wherein the spring is a torsion spring, a compression spring, or an extension spring.

7. The system of claim 3, wherein the system comprises multiple fold rollers, and wherein an initial positioning of each of the multiple fold rollers is such that movement of one fold roller overlaps the movement of another fold roller.

8. The system of claim 3, wherein the housing is translatable relative to the fold blade.

9. The system of claim 3, wherein the drive means is a single drive means.

10. A system for folding sheet material, comprising:

a fold blade;

at least one fold roller;

drive means for moving at least one of the fold blade and each of the at least one fold rollers along a first path into operable communication with one another, wherein the operative communication causes displacement of each of the at least one fold rollers along a longitudinal axis of the fold blade;

at least one arm, wherein each arm has one of the at least one fold rollers rotatably attached to a first end and the arm is pivotably attached to a housing of the fold apparatus; and a plurality of springs, one of the plurality of springs attached to a second end of each of the at least one arms, wherein the one spring forces the fold roller of the at least one arm against the fold blade as the fold roller rotates along the longitudinal axis of the fold blade.

11. The system of claim 10, wherein the drive means comprises:

a lead screw, wherein a rotation of the lead screw in a first direction is operable to move each of the at least one fold rollers against the fold blade to create a fold in a sheet material.

12. The system of claim 10, wherein the drive means is a single drive means.

13. The system of claim 10, wherein the spring is a torsion spring, a compression spring, or an extension spring.

14. The system of claim 10, wherein the system comprises multiple fold rollers, and wherein an initial positioning of each of the multiple fold rollers is such that movement of one fold roller overlaps the movement of another fold roller.

15. The system of claim 10, wherein the housing is translatable relative to the fold blade.

* * * * *